US006427292B1

(12) United States Patent
Seifert

(10) Patent No.: US 6,427,292 B1
(45) Date of Patent: Aug. 6, 2002

(54) CONNECTOR FOR THE REMOVABLE CONNECTION OF A NECK STRAP TO A PAIR OF BINOCULARS

(75) Inventor: Kuno Seifert, Mistelgau (DE)

(73) Assignee: Steiner-Optik GmbH, Bayreuth (DE)

( * ) Notice: Subject to any disclaimer, the term of this patent is extended or adjusted under 35 U.S.C. 154(b) by 0 days.

(21) Appl. No.: 09/689,728

(22) Filed: Oct. 13, 2000

(30) Foreign Application Priority Data

Oct. 16, 1999 (DE) ..... 199 49 920

(51) Int. Cl.[7] ..... A44C 5/18

(52) U.S. Cl. ..... 24/265 EC; 24/635; 24/3.1; 24/3.4; 24/535

(58) Field of Search ..... 24/3.1, 3.4, 265 BC, 24/265 EC, 535, 536, 537, 635; 294/139, 145, 158; 224/271, 272; 359/409–411, 815, 816; 396/420, 423, 424

(56) References Cited

U.S. PATENT DOCUMENTS

| | | | | | |
|---|---|---|---|---|---|
| 737,068 | A | * | 8/1903 | Briel | 24/635 X |
| 1,110,579 | A | * | 11/1914 | Seeber | 24/537 |
| 2,723,430 | A | | 11/1955 | Paillard | |
| 3,088,367 | A | * | 5/1963 | Haupt et al. | 359/409 |
| 3,526,347 | A | * | 9/1970 | Kuban | 359/409 X |
| 3,950,829 | A | * | 4/1976 | Cohen | 24/536 X |
| 4,370,040 | A | * | 1/1983 | Lange | 396/420 |
| 5,014,892 | A | * | 5/1991 | Copeland | 224/271 |
| 5,388,313 | A | * | 2/1995 | Cameron | 24/537 |
| 5,740,952 | A | * | 4/1998 | Huckenbeck | 224/271 |
| 6,003,213 | A | * | 12/1999 | Keller et al. | 24/635 |
| 6,282,802 | B1 | * | 9/2001 | Iden | 33/348 |

FOREIGN PATENT DOCUMENTS

| | | |
|---|---|---|
| DE | 1795433 | 7/1959 |
| DE | 1820554 | 8/1960 |
| DE | 82 04 508 U1 | 9/1982 |
| DE | 40 15 606 A1 | 11/1991 |

* cited by examiner

*Primary Examiner*—Anthony Knight
*Assistant Examiner*—Ruth C. Rodriguez
(74) *Attorney, Agent, or Firm*—Browdy and Neimark, P.L.L.C.

(57) ABSTRACT

In a connector for the removable connection of an end of a neck strap to a pair of binoculars or similar optical device, to provide for a simple connection and disconnection with a reliable hold, the end of the strap has an attached clip incorporating two legs that can be elastically opened in a V-shape and that have inward facing holding projections on their insides, wherein a holding part with a lug is provided on the binoculars, said lug incorporating snap-in projections that extend laterally toward the outside in a manner so that the legs can be snapped onto the lug in such a way that their holding projections encompass the snap-in projections of the lug, and wherein a retention sleeve is provided, the free interior cross-section of which is dimensioned such that it can be slipped over the legs when they are in their snapped-on position, thus preventing the legs from opening.

6 Claims, 4 Drawing Sheets

CONNECTOR FOR THE REMOVABLE CONNECTION OF A NECK STRAP TO A PAIR OF BINOCULARS

BACKGROUND OF THE INVENTION

Field of the Invention

The present invention is directed to a connector for the removable connection of an end of a neck strap to a pair of binoculars or similar optical device.

Binoculars have a neck strap that is connected with its ends to the left and right of the binoculars and permits the binoculars to be carried hanging in front of one's chest when they are not in use, so that, to be used, they can be conveniently grasped and raised with one's hands.

However, there are a number of applications, e.g., in the nautical field, where the users prefer to set the binoculars down instead of carrying them in front of their chests. In these applications the strap is considered more of an interference, so that it would be desirable to be able to remove it.

Customarily, to fasten the strap to the binoculars, it is guided through two spaced-apart slits that are provided on the binoculars and fixed. If one wishes to remove the strap, this is relatively laborious and re-attaching the strap to the binoculars is even more laborious.

SUMMARY OF THE INVENTION

Based on this, the invention has as its aim to create a connector of the above kind, which not only permits the implementation of a removable connection in principle, but also makes the connection and disconnection process so simple to perform that it can be carried out without difficulty and without any instructions. Furthermore, a connector of this type shall be designed such that it is also easily possible to retrofit conventional binoculars.

This aim is met according to the invention with the end of the strap having an attached clip incorporating two legs that can be elastically opened in a V-shape and that have inward facing holding projections on their insides, wherein a holding part with a lug is provided on the binoculars or the like, said lug incorporating snap-in projections that extend laterally toward the outside in a manner so that the legs can be snapped onto the lug in such a way that their holding projections encompass the snap-in projections of the lug, and wherein a retention sleeve is provided, the free interior cross-section of which is dimensioned such that it can be slipped over the legs when they are in their snapped-on position, thus preventing the legs from opening.

With this design it is possible to simply snap on the clip of the connector and securely anchor it by means of the retention sleeve.

In this context the design preferably provides for the retention sleeve to elastically lock into place behind a snap-in projection so that an unintentional disconnection is reliably prevented, even if the connector is subjected to heavier stresses.

Operating ribs that are provided on the outside of the retention sleeve facilitate its use.

The clip advantageously has on its top a cutout through which the neck strap is threaded, so that the neck strap can be connected to the clip in a manner known per se.

To provide for an easy retrofitting with an inventive connector in such a way that two spaced-apart slits are provided on the case of the binoculars or the like in a manner known per se, the holding part is form-fittingly insertable into the upper slit in the case, as viewed when the binoculars are in use, and a fastening part is form-fittingly insertable into the lower slit, as viewed when the binoculars are in use, in such a manner that the holding part and the fastening part are interlockable by means of a snap-in connection. Specifically, a snap-in projection of the fastening part may snap into a snap-in cutout of the holding part when inserted, causing the parts to be fixed relative to one another and relative to the case.

This inventive design thus takes advantage of the fact that slits are customarily provided on the case through which the straps are guided for direct attachment. By using a simple snap-in process, a conventional case of this type can be provided with a connector according to the invention.

The invention is described in detail below, based on a preferred embodiment in combination with the drawing.

DESCRIPTION OF THE PREFERRED EMBODIMENT

Figure 1:
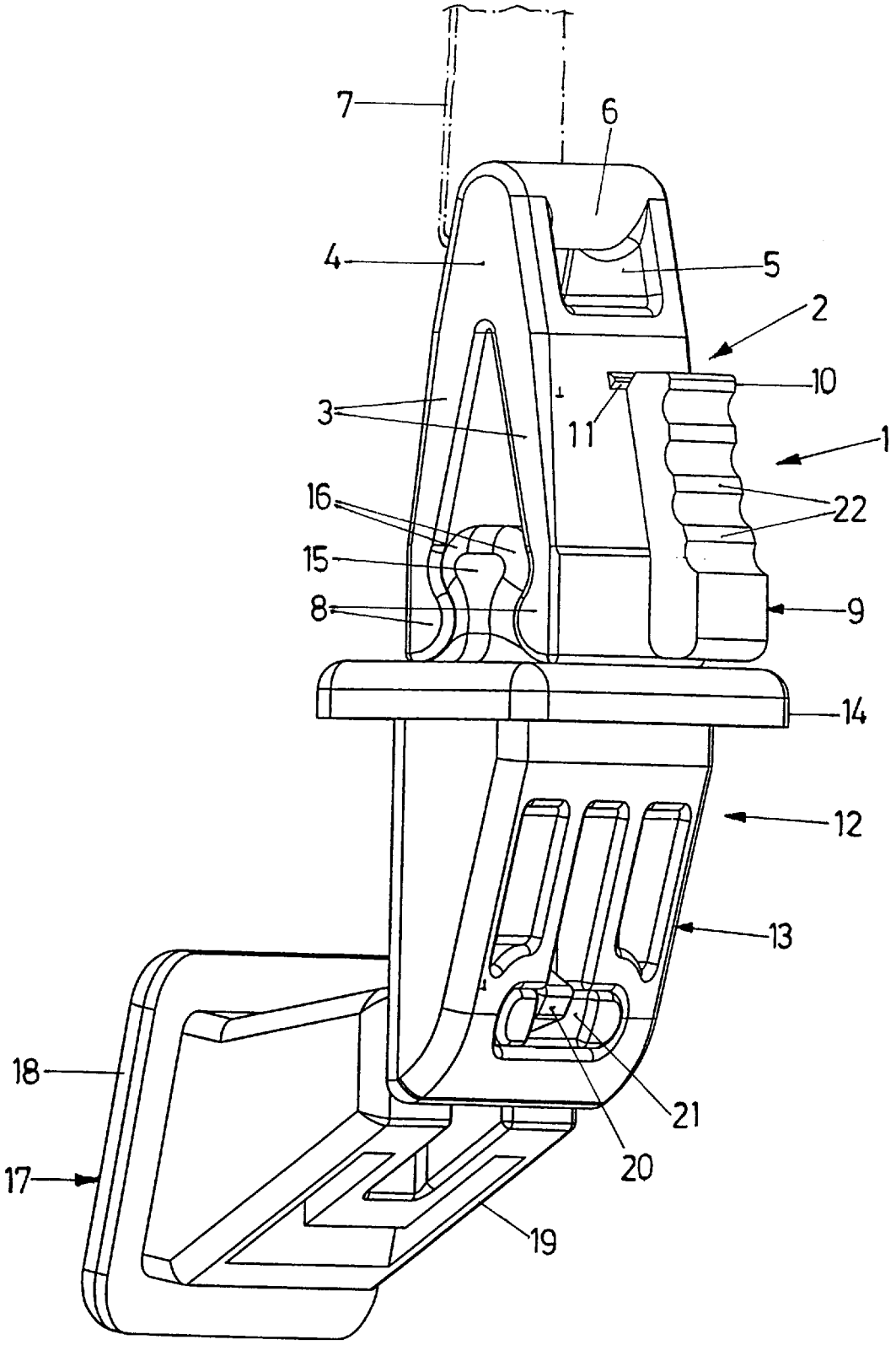
FIG. 1 is a perspective view of an inventive connector in its attached condition.
Figure 2:
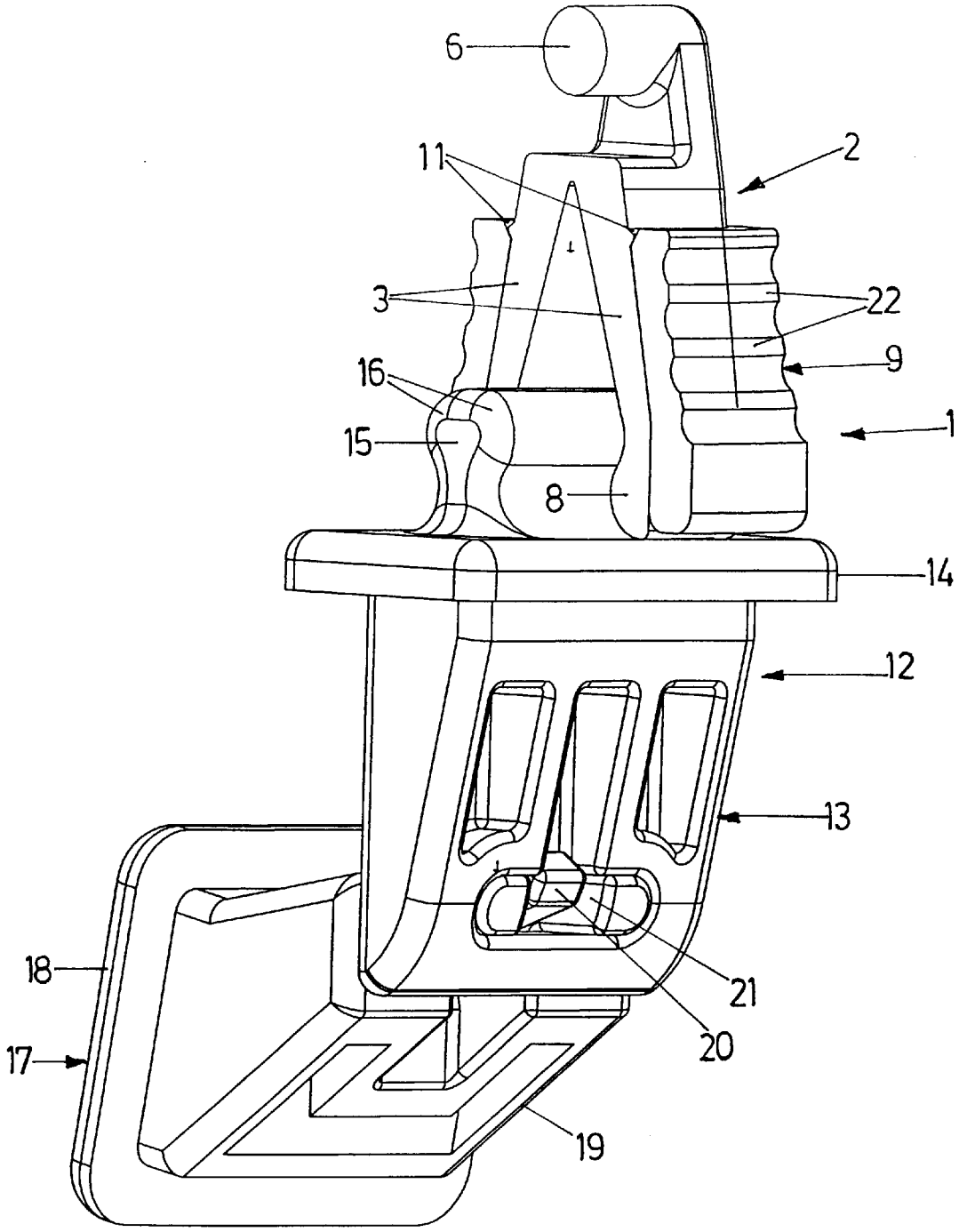
FIG. 2 is a view according to FIG. 1 with partial cut-away.

A connector 1 according to the invention encompasses a clip 2 with two legs 3 that are extruded as one piece and joined in a base area 4 in a manner so that they can be elastically opened. The area 4 also has a cutout 5 provided below a deflection bridge 6, through which the end of a neck strap 7 can be threaded in a manner known per se. The legs 3 have, at their lower ends, inward projecting holding projections 8.

A retention sleeve 9 encompasses the legs 3 of the clip 2 in a formfitting manner and restricts their possible opening angle. In the locked position shown in the drawing, the retention sleeve 9 locks into place with its upper edge 10 behind a snap-in projection 11.

The inventive connector 1 furthermore comprises a holding part 12 with a foot area 13 and a stop plate 14, from which a lug 15 extends upward, which has snap-in projections 16 that project toward the outside.

These snap-in projections 16 are dimensioned, relative to the holding projections 8 of the clip 2, such that when the clip 2 is locked into place over the snap-in projections 16 by means of its holding projections 8, it is possible to slide the retention sleeve 9 downward in a formfitting manner and thus prevent the legs 3 from opening, so that the clip 2 is fixed on the lug 15 in a form-fitting manner in such a way that locking the retention sleeve 9 into place behind the locking projection 11 ensures that this connection is not separated, even under mechanical stress. The retention sleeve has operating ribs 22 for easier manipulation.

Known binoculars or similar optical devices have two slits on their case that are arranged above one another and, until now, served to thread in the neck strap.

To affix the inventive connector, the foot part 13 of the holding part 12 is pushed through the upper slit until the stop plate 14 comes to rest on the case surface.

Through the lower slit, a fastening part 17 is inserted into the inside of the case, until its stop plate 18 comes to rest on the case surface. A projection 19 then projects into the interior of the case 23. This projection 19 has an elastically deflectable snap-in insert 20, which locks into place in a corresponding snap-in cutout 21 on the foot part 13 of the holding part 12 in such a way that the parts 12, 17 are snapped-in or locked relative to one another and reliably fixed to the case.

Figure 3:
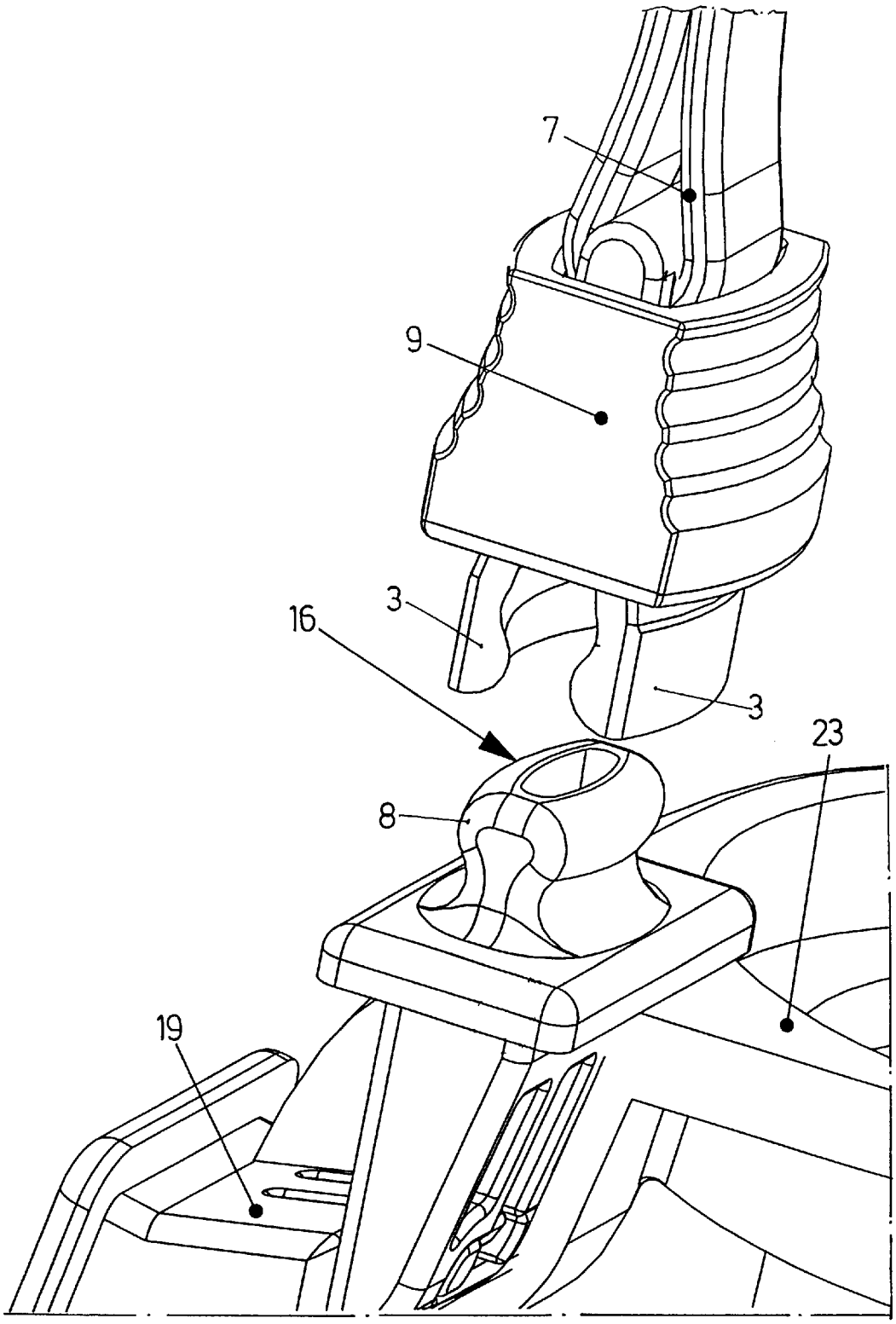
FIG. 3 is a view in the perspective, in its disconnected condition.
Figure 4:
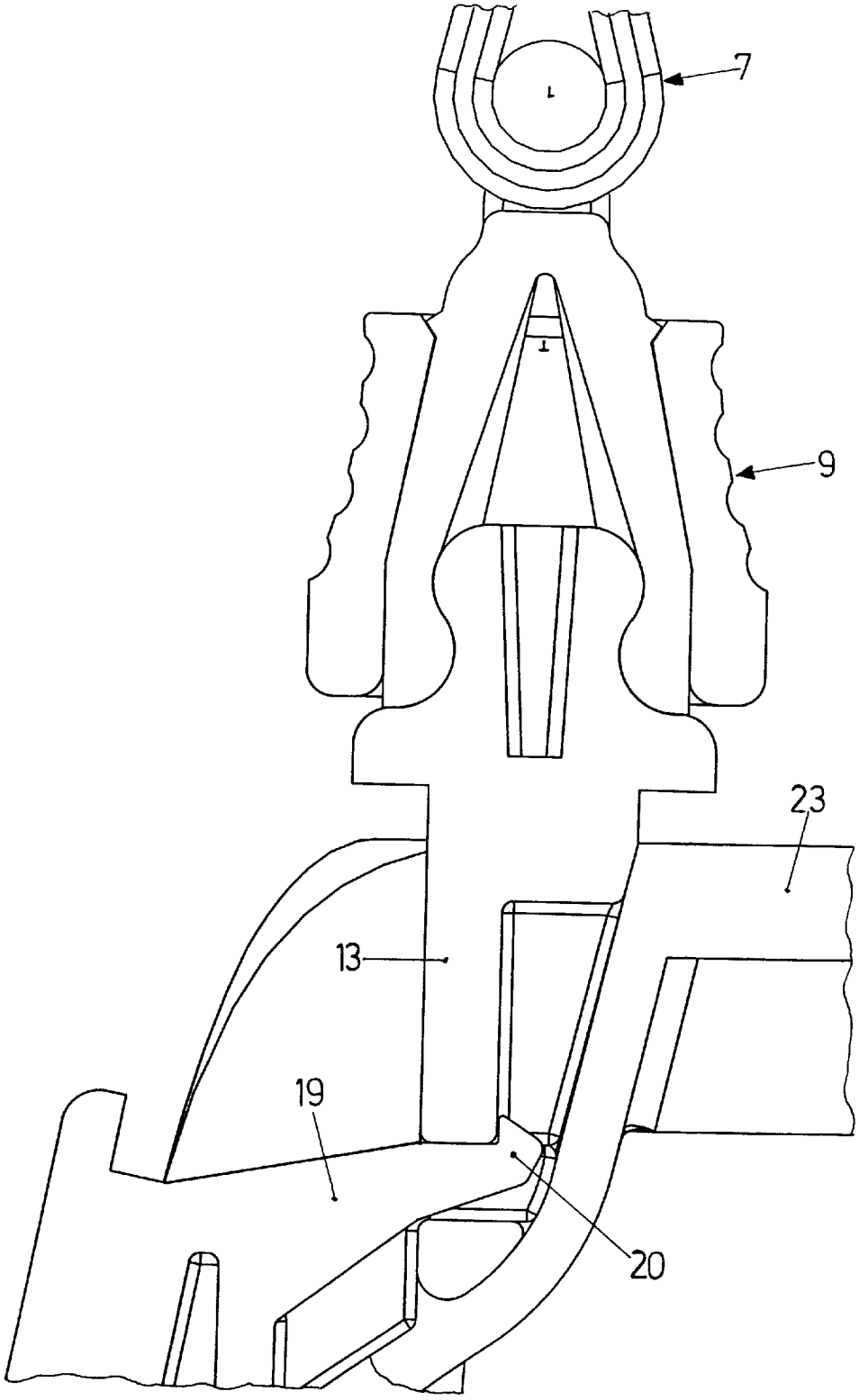
FIG. 4 is a sectional view.

As is apparent particularly from FIG. 3, the legs 3 have on their inside, and the holding projections 8 have in their top view an oval or approximately elliptic shape to facilitate centering of the legs during the connection process.

What is claimed is:

1. A connector for the removable connection of an end of a neck strap to an optical device, wherein on the end of the strap (7) a clip (2) is affixed, which has two legs (3) that can be elastically opened in a V-shape and that have inward facing holding projections (8) on their insides;

wherein a holding part (12) with a lug (15), which has snap-in projections (16) extending laterally toward the outside, is provided on the optical device;

wherein the legs (3) can be snapped onto the lug (15) in an manner so that their holding projections (8) encompass the snap-in projections (16) of the lug (15); and wherein a retention sleeve (9) is provided, the free interior cross-section of which is dimensioned such that it can be slipped over the legs (3) when they are in their snapped-on position, thus preventing the legs (3) from opening;

wherein two spaced-apart slits are provided on the case of the optical device, wherein the holding part (12) is insertable in a form-fitting manner into the upper slit of the case, as viewed when the optical device is in use, and a fastening part (17) is insertable in a form-fitting manner into the lower slit of the case, as viewed when the optical device is in use, in such a way that a holding part (12) and a fastening part (17) are interlockable by a snap-in connection.

2. A connector according to claim 1, wherein the retention sleeve (9) in its locked position elastically locks into place behind a snap-in projection (16).

3. A connector according to claim 1, wherein the retention sleeve (9) has operating ribs (22) on its outside.

4. A connector according to claim 1, wherein the clip (2) has on its top a cutout (5) for threading the neck strap (7) through.

5. A connector according to claim 1, wherein, during its insertion, a snap-in projection (20) of the fastening part (17) locks into place in a snap-in cutout (21) of the holding part (12), and the parts (12, 17) are thus fixed relative to one another and relative to the case.

6. A connector according to claim 1, wherein said optical device is a pair of binoculars.

* * * * *